US005941160A

United States Patent [19]

Kato et al.

[11] Patent Number: 5,941,160

[45] Date of Patent: Aug. 24, 1999

[54] PISTONS FOR COMPRESSORS AND METHOD AND APPARATUS FOR COATING THE PISTONS

[75] Inventors: Takayuki Kato; Takahiro Sugioka; Shigeo Fukushima; Masato Takamatsu; Hayato Ikeda; Toru Takeichi; Tetsuya Takashima; Masanobu Yokoi, all of Kariya, Japan

[73] Assignee: Kabushiki Kaisha Toyoda Jidoshokki Seisakusho, Aichi-ken, Japan

[21] Appl. No.: 08/888,883

[22] Filed: Jul. 7, 1997

[30] Foreign Application Priority Data

Jul. 8, 1996 [JP] Japan ..... 8-177896
Apr. 22, 1997 [JP] Japan ..... 9-104405

[51] Int. Cl.[6] ..... F04B 39/00; F04B 27/12

[52] U.S. Cl. ..... 92/155; 92/71

[58] Field of Search ..... 92/153, 158, 138, 92/223, 212, 248, 155, 71

[56] References Cited

U.S. PATENT DOCUMENTS 1,864,384 6/1932 Ware ..... 92/158
4,263,814 4/1981 Takaoka et al. ..... 74/60
4,384,518 5/1983 Albin .
4,519,119 5/1985 Nakayama et al. ..... 92/138 X
4,885,992 12/1989 Duce .
5,314,717 5/1994 Alt ..... 92/223 X
5,435,873 7/1995 Penrice ..... 92/223 X

FOREIGN PATENT DOCUMENTS 57-86580 5/1982 Japan .
1-193068 8/1989 Japan .

OTHER PUBLICATIONS

Patent Abstracts of Japan, vol. 013, No. 485 (M–887) re JP 01 193068 A, published Aug. 3, 1989.

*Primary Examiner*—John E. Ryznic
*Attorney, Agent, or Firm*—Morgan & Finnegan, L.L.P.

[57] ABSTRACT

A piston for a compressor. The piston has a lubricating coating that slidably contacts with an inner surface of the cylinder bore. The layer is formed on the surface of the piston. The layer is formed by transferring a liquid material to the surface of the piston using printing techniques such as screen printing and roller coating.

5 Claims, 7 Drawing Sheets

Fig.10
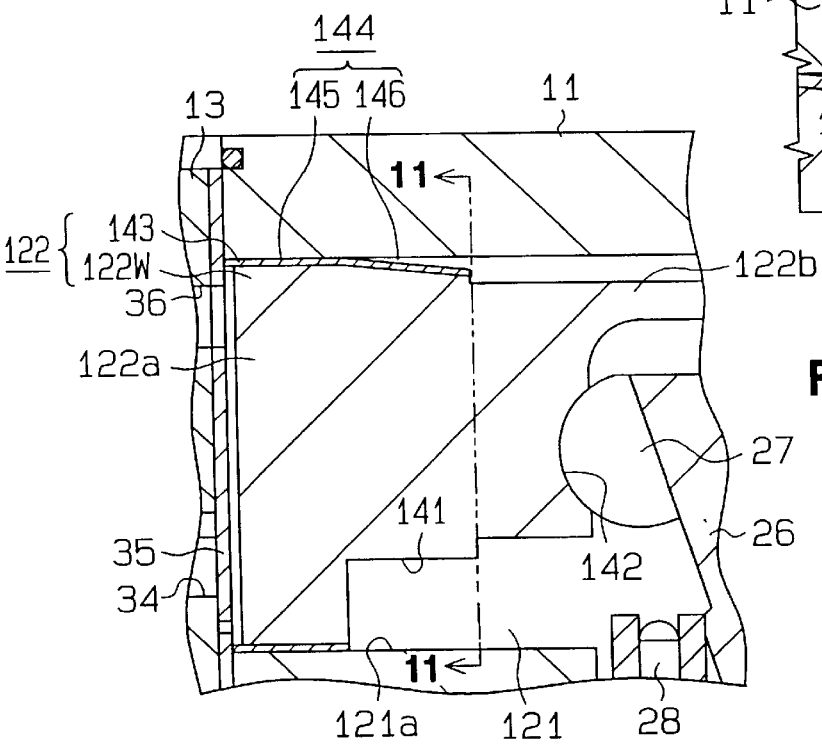
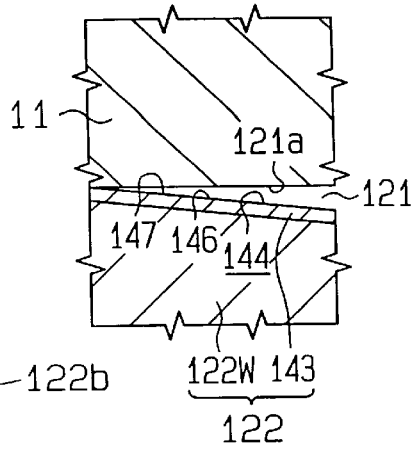
Fig.10(a)
Fig.11
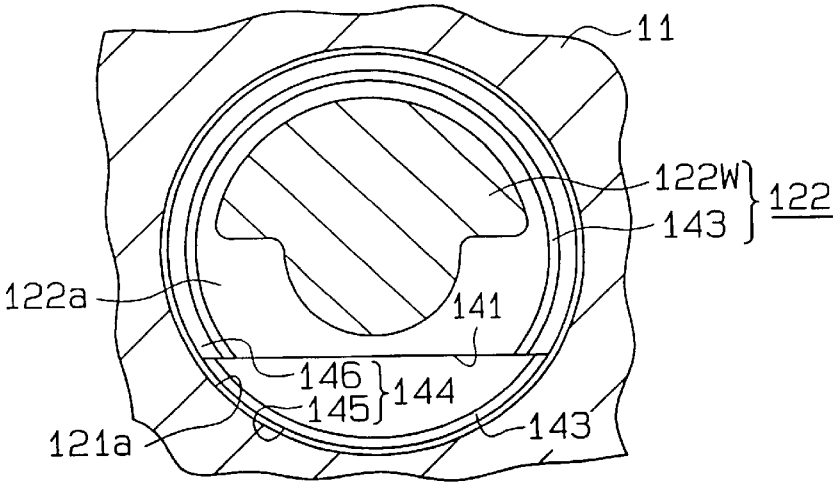

PISTONS FOR COMPRESSORS AND METHOD AND APPARATUS FOR COATING THE PISTONS

BACKGROUND OF THE INVENTION

The present invention relates to pistons for compressors and methods and apparatuses for coating the compressor pistons.

A typical piston type compressor employed in an air-conditioning system includes a housing and a drive shaft, which is supported in the housing. A swash plate is fixed to the drive shaft and supported so as to rotate integrally with the shaft. The housing includes a cylinder block. The cylinder block is provided with cylinder bores. Each cylinder bore accommodates a piston. The piston is coupled to a swash plate by means of shoes. A compression chamber is defined in each cylinder bore by the associated piston. The integral rotation of the drive shaft and the swash plate reciprocates the pistons. The reciprocation of each piston alters the volume of the associated compression chamber and causes compression of the refrigerant gas drawn into the compression chamber.

A typical piston is substantially cylindrical. The outer surface of the piston contacts the wall of the associated cylinder bore. With such a piston, it is required that the space between the piston and the wall of the associated bore be sealed. Furthermore, it is required that the piston and the wall of the cylinder bore have an anti-abrasion property.

The outer surface of the piston is coated by a material, the main component of which is polytetrafluoroethylene (PTFE) or the like to improve the sealing and anti-abrasion properties of the piston. The coating material is sprayed onto the piston.

However, spray coating has the following disadvantages:

(1) In addition to portions that require application of the coating, portions that do not require sealing and anti-abrasion properties are also coated. Furthermore, some of the coating material is dispersed around the piston and is wasted.

(2) Each piston is provided with a seat to receive the associated shoe. Since a clearance having a predetermined dimension must accurately be provided between the shoe and the shoe seat, it is preferable that the shoe not be coated. Application of a coating to the shoe seat changes the clearance dimension. Thus, the shoe seat is masked to prevent application of the coating. The masking process and the masking removal process increases the number of steps required during coating of the piston.

(3) Peripheral equipment such as a protection fence must be arranged in the room in which the coating process is carried out to prevent the coating from being widely dispersed. Furthermore, the coating sprayed onto such peripheral equipment must be cleaned periodically.

For the reasons described above, the application of a coating to the piston, increases costs. This leads to an increase in the price of the compressor.

SUMMARY OF THE INVENTION

Accordingly, it is an objective of the present invention to provide a piston, and a method and apparatus for coating the piston in an accurate and inexpensive manner.

To achieve the above objective, the present invention provides a piston for use in a compressor, a method for coating and an apparatus for coating. An outer surface of the piston includes an outer sliding surface that has a curvature conforming to the curvature of a cylinder bore. The outer sliding surface is transfer coated with a lubricant coating.

An apparatus is provided for forming a coating on the surface of a piston accommodated in a cylinder bore of a compressor, the surface including an outer sliding surface on which the coating is formed, the outer sliding surface having a curvature conforming to that of the cylinder bore. The apparatus comprises a piston support for supporting the piston, and a coating device opposed to the cylindrical surface of the piston for transferring liquid material from the coating device to the first surface of the piston.

A method is provided for forming a coating on an outer sliding surface of compressor piston, wherein the coating slidably contacts the cylinder bore, and wherein the outer sliding surface of the piston has a predetermined shape. The method comprises supporting the piston, positioning a coating device in close proximity to the piston, transferring liquid coating material from the coating device to the outer sliding surface of the piston with the coating device, wherein the coating device includes a printing portion the shape of which matches the predetermined shape of the outer sliding surface.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 3(*b*) is a plan view showing the screen coating apparatus;

FIG. 5(*b*) is a front view showing a printing roller of the roll coating apparatus;

FIG. 7(*b*) is a plan view showing a screen coating apparatus;

FIG. 7(*c*) is a front view showing a printing roller according to a fourth embodiment of the present invention;

FIG. 10 is a cross-sectional view showing a single-headed piston according to a seventh embodiment of the present invention;

FIG. 10(*a*) is an enlarged and fragmentary cross-sectional view showing a portion of FIG. 10; and FIG. 11 is a cross-sectional view taken along line 11—11 in FIG. 10.

DETAILED DESCRIPTION OF THE PREFERRED EMBODIMENTS

A double-headed piston type compressor according to a first embodiment of the present invention will now be described with reference to FIGS. 1 and 2.

Figure 1:
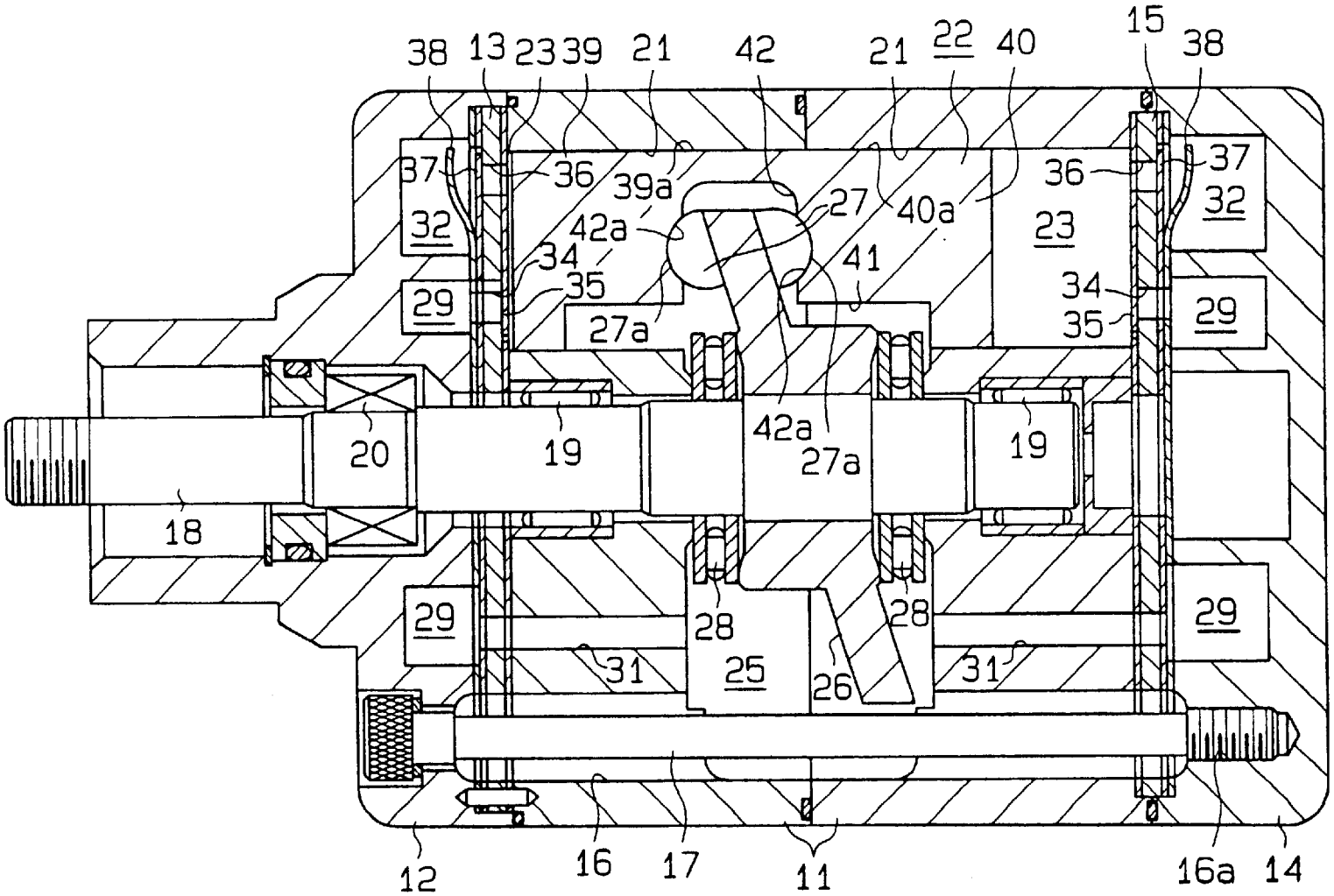
FIG. 1 is a cross-sectional view showing a double-headed piston type compressor according to a first embodiment of the present invention.

As shown in FIG. 1, a pair of cylinder blocks 11, which are made of aluminum alloy, are coupled to each other. A front housing 12 is coupled to the front end of the cylinder block 11 with a valve plate 13 arranged in between. A rear housing 14 is coupled to the rear end of the cylinder block 11 with a valve plate 15 arranged in between.

A plurality of bolt holes 16 extend between the front housing 12 and the rear housing 14. A bolt 17 is inserted into each bolt hole 16 from the front housing 12 and screwed into a threaded hole 16a provided in the rear housing 14. Thus, the bolts 17 integrally fasten the housings 12, 14, the cylinder blocks 11, and the valve plates 13, 15 to one another.

A drive shaft 18 extending through the center of the cylinder blocks 11 and the front housing 12 is rotatably supported by a pair of radial bearings 19. A lip seal 20 is arranged between the periphery of the front end of the drive shaft 18 and the front housing 12. The drive shaft 18 is operably connected to and driven by an external drive source such as a vehicle engine.

Pairs of front and rear cylinder bores 21 extend through the cylinder blocks 11 about the drive shaft 18. A double-headed piston 22 is reciprocally accommodated in each pair of cylinder bores 21. In each cylinder bore 21, a compression chamber 23 is defined between the piston 22 and the associated valve plate 13, 15.

A crank chamber 25 is defined between the cylinder blocks 11. A swash plate 26 is fixed to the drive shaft 18 in the crank chamber 25. The middle portion of each piston 22 is coupled to the swash plate 26 by a pair of shoes 27. Each shoe 27 has a convex surface 27*a* that is supported by a concave surface 42*a* of the associated piston 22. The oscillation of the swash plate 26 caused by the rotation of the drive shaft 18 is transmitted to each piston 22 by means of the shoes 27. This reciprocates the piston 22 in the associated cylinder bore 21. A pair of thrust bearings 28 are arranged between the cylinder blocks 11 and the front and rear sides of the swash plate 26. The crank chamber 25 is connected to an external refrigerant circuit by way of a suction port (not shown).

A suction chamber 29 is defined in the center portion of the each housing 12, 14. A suction passage 31 extends through each cylinder block 11 and the associated valve plate 13, 15 to connect the suction chambers 29 to the crank chamber 25.

A plurality of suction ports 34 and discharge ports 36 extend through the valve plates 13, 15 in correspondence with the cylinder bores 21. A suction valve 35 is provided for each suction port 34 in the valve plates 13, 15. Each suction valve 35 selectively opens and closes the associated suction port 34. A discharge valve 37 is provided for each discharge port 36 in the valve plates 13, 15. Each discharge valve 36 selectively opens and closes the associated discharge port 37. A retainer 38 is provided for each valve plate 13, 15 to restrict the opening angle of the discharge valves 37. When each piston 22 is moved from the top dead center position to the bottom dead center position, the associated suction valve 35 is opened. This draws refrigerant gas into the compression chamber 23 from the associated suction chamber 29. When each piston 22 is moved from the bottom dead center position to the top dead center position, the refrigerant gas is compressed to a predetermined pressure and then discharged into the associated discharge chamber 32. The discharged refrigerant gas is sent to the external refrigerant circuit through a discharge port (not shown).

Figure 2:
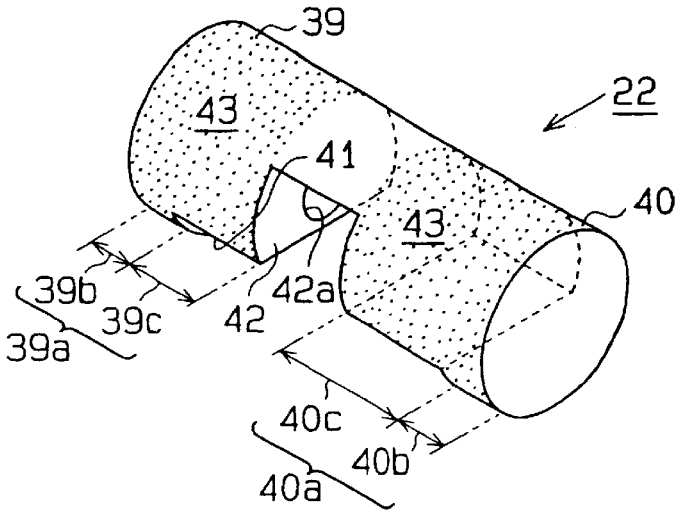
FIG. 2 is a perspective view showing the double-headed piston of FIG. 1.

As shown in FIG. 2, the pistons 22 are substantially cylindrical casted products that are made of aluminum alloy. Each piston 22 has a first head 39, which is retained in the front cylinder bore 21, and a second head 40, which is retained in the associated rear cylinder bore 21. A recess 41 is defined between the first head 39 and the second head 40. A slot 42 is provided in the recess 41 to accommodate the swash plate 26 and the associated shoes 27. Opposed concave seats 42a are provided in the slot 42 with a predetermined interval therebetween. The convex surface 27*a* of each shoe 27 is supported by the associated concave surface 42*a*. The shoe 27 and the associated slot 42 form a swivel joint structure. Each piston 22 has peripheral surfaces 39*a*, 40*a*. The peripheral surface 39*a* includes a first surface 39*b*, which extends for 360 degrees in the circumferential direction, and a second surface 39*c*, which extends for less than 360 degrees in the circumferential direction to the recess 41. In the same manner, the peripheral surface 40*a* includes a first surface 40*b*, which extends for 360 degrees in the circumferential direction, and a second surface 40*c*, which extends in the circumferential direction only to the recess 41.

A coating 43, the main component of which is polytetrafluoroethylene (PTFE), is applied to the peripheral surface 39*a* of the first head 39 and to the peripheral surface 40*a* of the second head 40. The thickness of the coating 43 is 20 to 40 micrometers. The coating 43 is not applied to the area between the heads 39, 40 nor to the end surfaces that do not contact the wall of the cylinder bore 21. The coating 43 improves the anti-abrasion property of the piston 22 and decreases friction between the piston 22 and the wall of the associated cylinder bore 21. Contact between the coating 43 and the wall of the cylinder bore 21 enhances the sealing of the space between the front compression chamber 23 and the crank chamber 25 and between the rear compression chamber 23 and the crank chamber 25.

A method for applying the coating to the peripheral surfaces 39*a*, 40*a* of the pistons 22 will now be described with reference to FIGS. 3(*a*), 3(*b*), and 4.

Figure 3A:
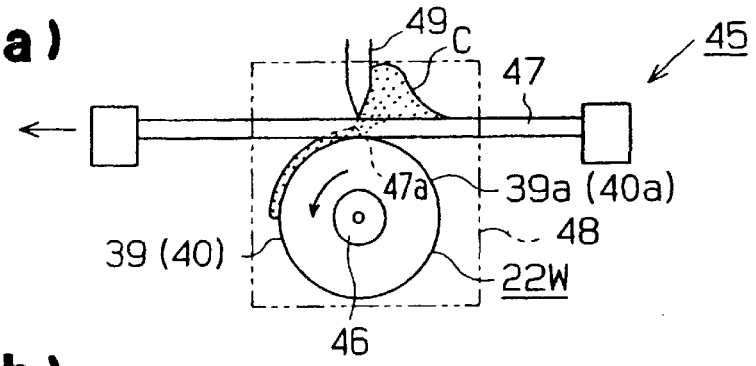
FIG. 3(*a*) is a diagrammatic view showing a screen coating apparatus.
Figure 3B:
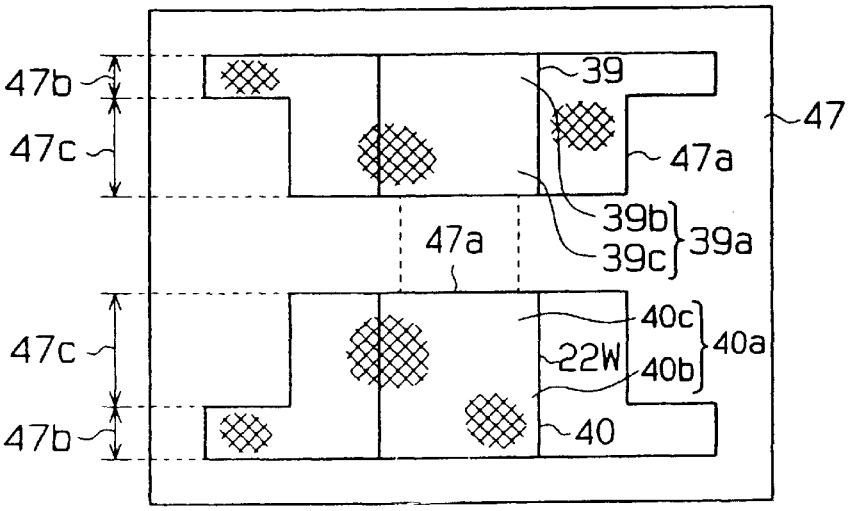

As shown in FIG. 3(*a*), a screen coating apparatus 45, is employed to apply the coating 43 to the peripheral surface of a piston workpiece 22W (the piston 22 before application of the coating 43). The coating apparatus 45 uses the screen printing method. In other words, the coating apparatus 45 transfers a coating material C to the peripheral surface of the workpiece 22W. The coating material C contains an adhesive such as a binder resin, a lubricant such as PTFE, a solvent such as N-methylpyrrolidone, and a filler.

The coating apparatus 45 is provided with a workpiece holder 46, a screen 47 having a meshed transfer pattern 47*a*, a drive mechanism 48, which moves the screen 47 in a linear manner and rotates the holder 46, and a squeegee 49, which wipes the upper surface of the screen 47. The holder 46 holds the workpiece 22W by clamping the ends of the workpiece 22W. The drive mechanism 48 incorporates a motor (not shown).

As shown in FIG. 3(*b*), the transfer pattern 47*a* of the screen 47 is substantially formed in correspondence with a layout of the peripheral surfaces 39*a*, 40*a* of the workpiece 22W. Accordingly, the transfer pattern 47*a* has first areas 47*b*, which correspond to the first surfaces 39*b*, 40*b*, and second areas 47*c*, which correspond to the second surfaces 39*c*, 40*c*.

The coating material C is first applied to the upper surface of the screen 47 to form the coating 43. The actuation of the drive mechanism 48 rotates the workpiece 22W in a direction marked by an arrow and moves the screen 47 in the direction marked by an arrow, as shown in FIG. 3(*a*). The rotating speed of the workpiece 22W and the moving speed of the screen 47 is synchronized by the drive mechanism 48. The squeegee 49 is in contact with the upper surface of the screen 47. The workpiece 22W is held between the workpiece holder 46 and the screen 47. Accordingly, the movement of the screen 47 causes the squeegee 49 to apply the coating material C to the screen 47. The coating material C passes through the transfer pattern 47*a* of the screen 47. The synchronized rotation of the workpiece 22W and the movement of the screen 47 transfers the material C, which passes through the transfer pattern 47*a*, to the peripheral surfaces 39*a*, 40*a* of the workpieces 22W.

After transferring the coating material C, the workpiece 22W is removed from the holder 46. The workpiece 22W then undergoes a drying process to remove the solvent. The workpiece 22W also undergoes a calcination process to calcine the coating material C. This forms the coating 43, the thickness of which is, for example, 50 micrometers, on the peripheral surface 39*a*, 40*a* of the workpiece 22W.

Figure 4:
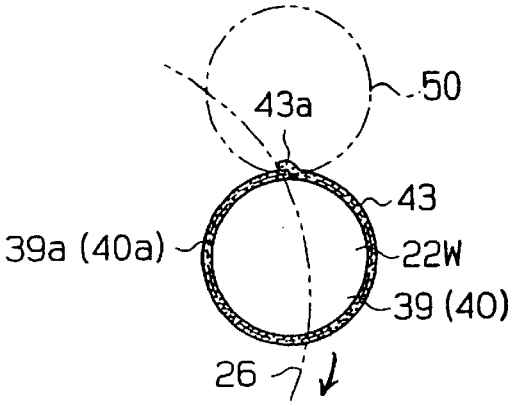
FIG. 4 is a side view showing the piston before undergoing the grinding process.

As shown in FIG. 4, a seam 43*a*, which is thicker than the other portions of the coating 43, forms at a position where the beginning and ending of the coating material C overlap. The workpiece 22W undergoes a grinding process to remove the seam 43*a* and grind the coating 43 to a predetermined thickness (20 to 40 micrometers). A grinding stone 50, which is shown by the dotted lines in FIG. 4, is used to grind the workpiece 22W. The thickness of the coating 43 is illustrated in an exaggerated manner in FIG. 3(*a*) and 4 to facilitate understanding. Referring to FIG. 4, the location of the seam 43*a*, or overlapped ends of the coating 43, is shown in relation to the rotating swash plate 26. Among the force components applied to the piston 22 by the swash plate 26 is a lateral component in the direction of rotation of the swash plate 26. As a result, the force between the piston 22 and the cylinder bore 21 is greater at the side of the piston 22 that transfers this force component to the bore 21. This side of the piston 22 is in the lower part of FIG. 4. It is preferred that the seam 43*a* be located opposite to the location where this force is applied as shown in FIG. 4. In other words, the seam 43*a* is preferably located on the side of the piston 22 where the swash plate 26 enters the slot 42 as opposed to where the swash plate exits the slot 42.

As described above, the coating material C is transferred to the piston workpiece 22W by using the screen coating apparatus 45. This results in the advantageous effects described below.

(1) The transfer pattern 47*a* enables the screen 47 to transfer the coating material C only to surfaces that need to be coated. Thus, the coating 43 is formed only on the peripheral surfaces 39*a*, 40*a*. This eliminates the need for masking of the workpiece W as in the prior art. Thus, masking the workpiece 22W and removing the masking from the workpiece 22W are not necessary in this embodiment. Furthermore, the coating material C is used in an economic manner. In addition, the coating material C is not dispersed about the coating apparatus 45. This eliminates the need for peripheral equipment such as a fence to prevent wide-spread dispersion of the coating material C. As a result, the coating 43 is applied to the designated portions 39*a*, 40*a* in a conserved manner. These pistons 22 enable production of a more inexpensive piston and decreases the production costs of the compressor.

(2) The coating 43 is not applied to the slot 42 of the piston 22. This maintains the predetermined dimension of the clearance between the shoe seats 42*a* and the shoes 27.

(3) The transfer pattern 47*a* of the screen 47 is relatively simple to form even if the pattern is complicated. Accordingly, the coating 43 is positively applied to the peripheral surfaces 39*a*, 40*a*. Pistons having different shapes may be coated in a similar manner by altering the transfer pattern 47*a*.

(4) The seam formed by the ends of the layer of the coating 43 is located at a position on the piston 22 that receives a low force relative to other parts of the piston 22. This prevents peeling of the coating 43.

A second embodiment according to the present invention will now be described. In this embodiment, a roll coating apparatus 51 is employed in lieu of the screen coating apparatus 45 to transfer the coating material C to the piston workpiece 22W.

To avoid a redundant description, like or same reference numerals are given to those components that are like of the same as the corresponding components of the first embodiment.

Figure 5A:
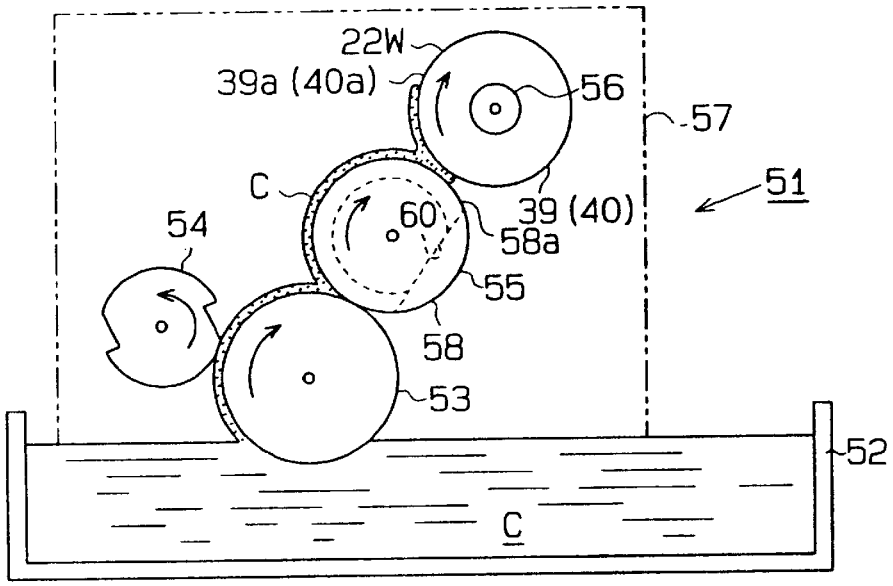
FIG. 5(*a*) is a diagrammatic view showing a roll coating apparatus according to a second embodiment of the present invention.
Figure 5B:
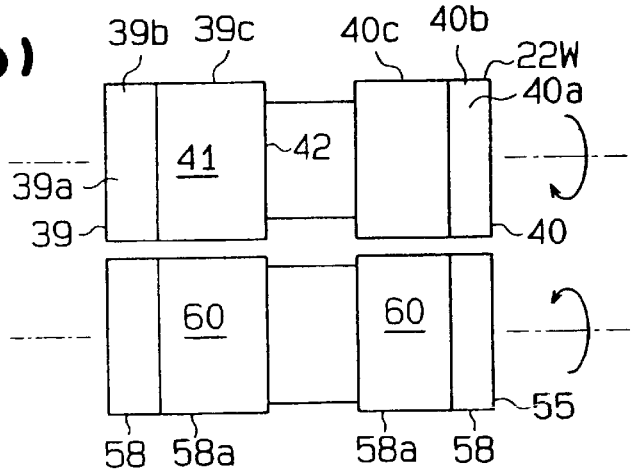

As shown in FIG. 5(*a*), the roll coating apparatus 51 includes a pan 52, which contains the coating material C, a metal roller 53, a comma roller 54, a printing roller 55, a workpiece holder 56, and a drive mechanism. The cylindrical metal roller 53 is arranged to contact the coating material C in the pan 52. The comma roller 54 is spaced from the metal roller 53 with a predetermined interval therebetween. The printing roller 55, which is made of a synthetic rubber, contacts the metal roller 53. The workpiece holder 56 rotatably holds the workpiece 22W. The holder 56 and the rollers 53–55 are rotated by a motor incorporated in a drive mechanism 57 in directions indicated by arrows.

As shown in FIG. 5(*b*), a large diameter portion 58 is provided on each end of the printing roller 55 in correspondence with the peripheral surfaces 39*a*, 40*a* of the workpiece 22W. The layout shape of each large diameter portion 58 is substantially identical to the shape of the transfer pattern 47*a* of the screen 47 employed in the first embodiment. Each large diameter portion 58 has a recess 60, which corresponds to the recess 41 of the workpiece 22W. The drive mechanism 57 synchronizes the rotation of the printing roller 55 and the workpiece 22W. This matches the positions of the recesses 60 of the printing roller 55 with the locations of the recesses 41 of the workpiece 22W.

Actuation of the drive mechanism 57 rotates the rollers 53–55 and the workpiece 22W. This applies the coating material C in the pan 52 to the metal roller 53. The thickness of the applied coating material C is adjusted by the comma roller 54. The coating material C on the metal roller 53 is then conveyed to the printing roller 55. Only the large diameter portions 58 of the printing roller 55 contact the metal roller 53. Thus, the coating material C applied on the metal roller 53 is applied only to the peripheral surfaces 58*a* of the large diameter portions 58. The coating material C applied to the large diameter portions 58 is then transferred to the peripheral surfaces 39*a*, 40*a* of the workpiece 22W.

The coating material C transferred to the workpiece 22W subsequently undergoes the drying, calcination, and grinding processes.

In addition to the advantageous effects of the first embodiment, this embodiment also decreases the running cost of the roller coating apparatus 51.

A third embodiment according to the present invention will now be described. A single-headed piston type compressor is shown in FIGS. 6 and 7.

Figure 6:
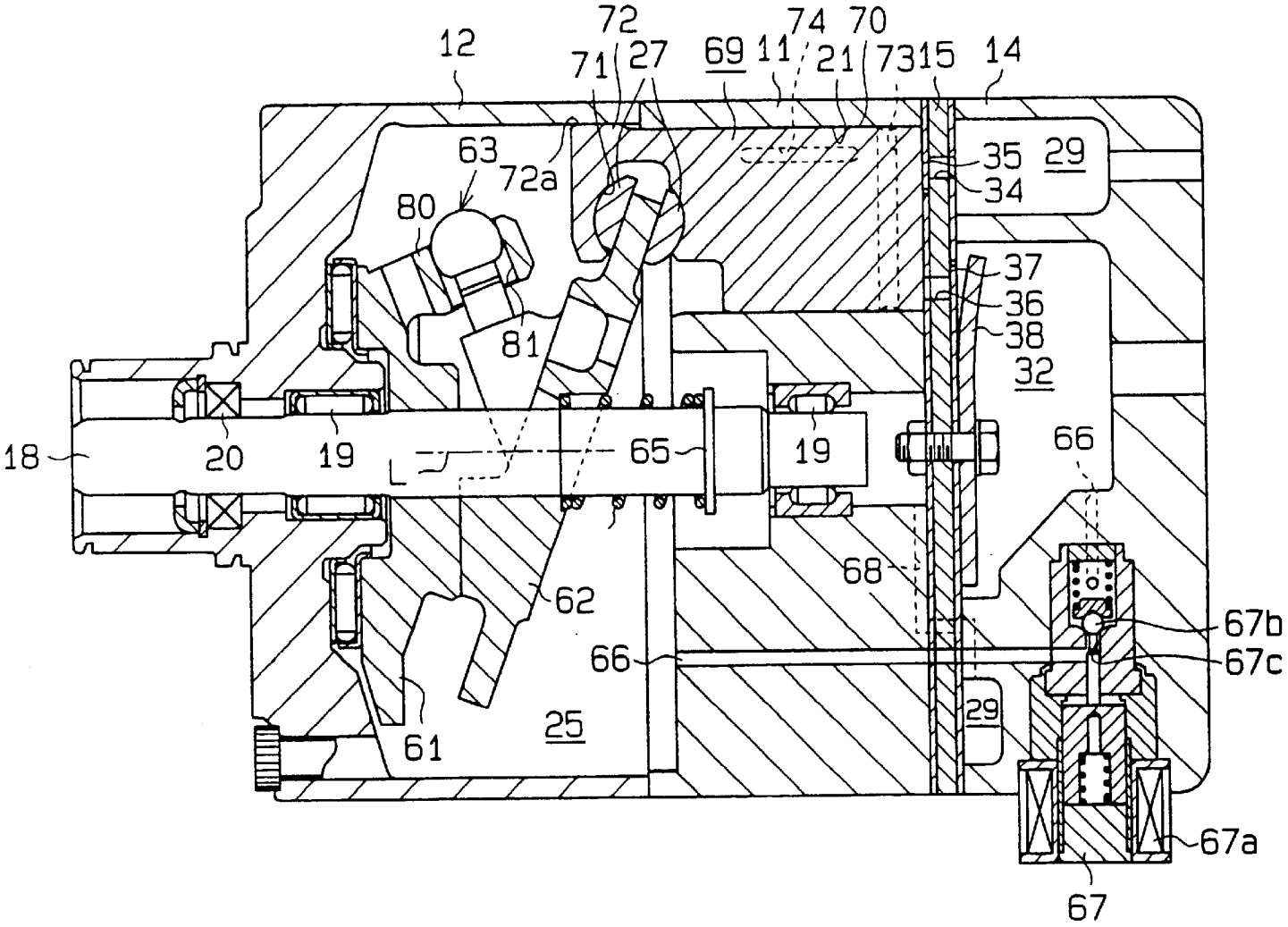
FIG. 6 is a cross-sectional view showing a single-headed piston type compressor according to a third embodiment of the present invention.
Figure 7A:
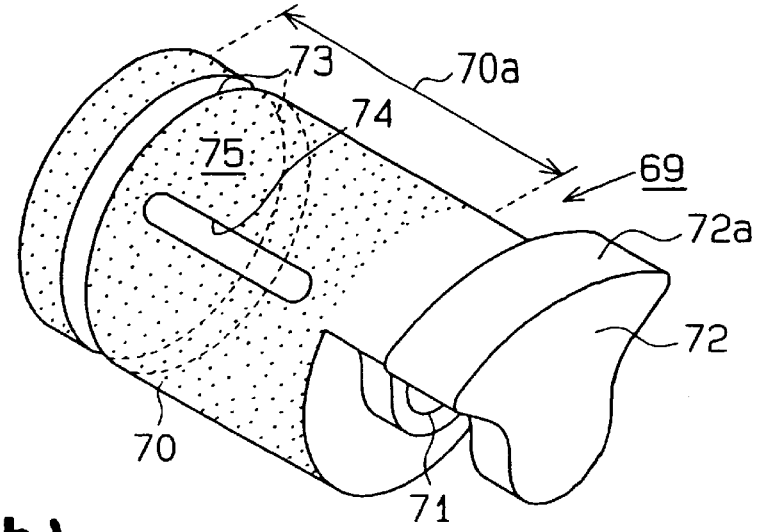
FIG. 7(*a*) is a perspective view showing the single-headed piston employed in the compressor of FIG. 6.
Figure 7B:
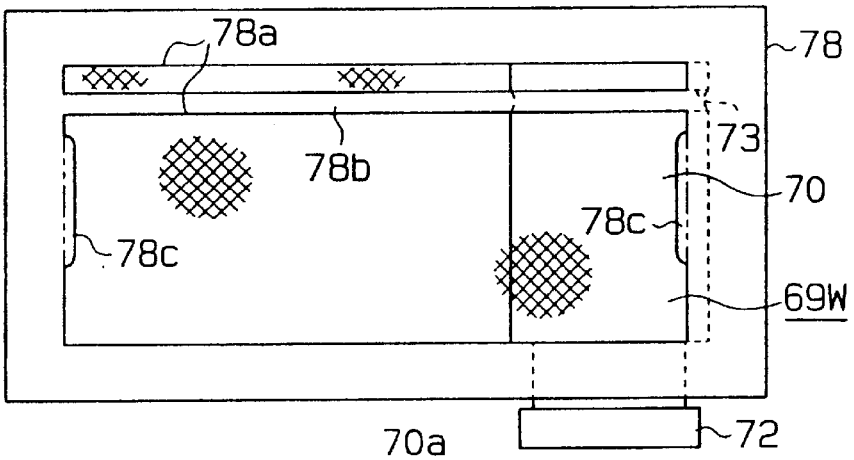
Figure 7C:
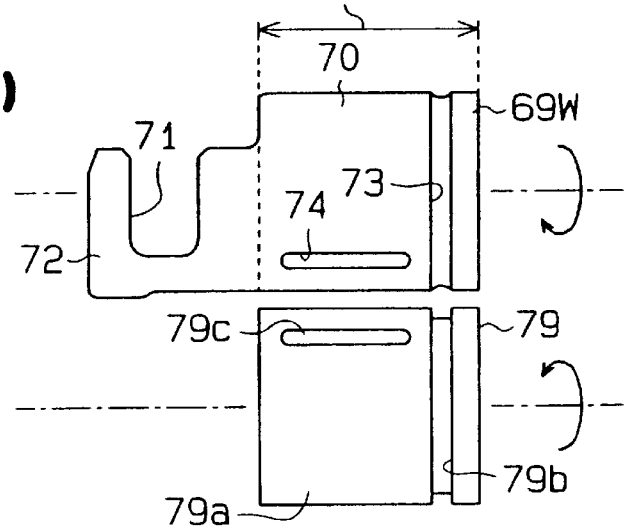

As shown in FIG. 6, a front housing 12 is secured to the front end of a cylinder block 11. A rear housing 14 is secured to the rear end of the cylinder block 11. A crank chamber 25 is defined in the cylinder block 11 and the front housing 12. Cylinder bores 21 are provided in the cylinder block 11. A single-headed piston 69 is accommodated in each cylinder bore 21. A suction chamber 29 and a discharge chamber 32 are defined in the rear housing 14.

A drive shaft 18 is supported by the cylinder block 11 and the front housing 12 by means of bearings 19. A rotor 61 is fixed to the middle of the drive shaft 18. The rotor 61 has a support arm 80. A swash plate 62 is fit to the drive shaft 18 and supported so that it is slidable in the axial direction of the shaft 18 and so that it rotates integrally with the shaft 18. The swash plate 62 is provided with connecting pins 63. The connecting pins 63 are fit into guide bores 81 that are defined in the support arm 80. The connecting pins 63 move through the guide bores 81. This changes the inclination of the swash plate 62. The abutment of the swash plate 62 against a stopper 65 restricts the swash plate 62 to a minimum inclination position. The abutment of the swash plate 62 against the rotor 61 restricts the swash plate 62 to a maximum inclination position.

A pressurizing passage 66 connects the discharge chamber 32 and the crank chamber 25. A displacement control valve 67 is retained in the rear housing to open and close the pressurizing passage 66. The control valve 67 includes a solenoid 67*a*, a spool 67*b*, and a port 67*c*. When the solenoid 67*a* is excited, the spool 67*b* closes the port 67*c*. When the solenoid 67*a* is de-excited, the spool 67*b* opens the port 67*c*. A pressure release passage 68 connects the crank chamber 25 and the suction chamber 29. The control valve 67 is controlled by a computer (not shown) in accordance with the cooling load of an external refrigerant circuit. The pressure in the crank chamber 25 is controlled by opening and closing the pressurizing passage 66. This adjusts the difference between the pressure in the crank chamber 25 and the pressure in the cylinder bores 21.

When the pressurizing passage 66 is closed, the pressure in the crank chamber 25 is released into the suction chamber 29 through the release passage 68. This causes the pressure level in the crank chamber 25 to decrease and approach the pressure level in the suction chamber 29. In this case, the swash plate 62 is maintained at the maximum inclination position. The stroke of each piston 69 is large when the swash plate 62 is located at the maximum inclination position. Thus, the amount of refrigerant gas discharged by the piston 69 is maximum.

When the pressurizing passage 66 is opened, the high pressure of the discharge chamber 32 is communicated to the crank chamber 25. This increases the pressure in the crank chamber 25 and moves the swash plate 62 to the minimum inclination position. In such state, the stroke of each piston 69 is small. Thus, the amount of refrigerant gas discharged by the piston 69 is minimum.

As shown in FIG. 7(*a*), the piston 69 includes a cylindrical piston body 70 and a skirt 72, which is formed integrally with the piston body 70. A shoe seat 71 is provided between the piston body 70 and the skirt 72. The peripheral surface 72*a* of the skirt 72 contacts the inner wall of the front housing 12 and restricts rotation of the piston 69. A ring groove 73 extends circumferentially about the distal end of the piston body 70. Lubricating oil, which is suspended in the refrigerant gas, collects on the wall of the cylinder bore 21. As the piston 69 reciprocates, the lubricating oil on the bore wall is collected in the ring groove 73. A linear groove 74 extends in the axial direction along the peripheral surface 70*a* of the piston body 70 toward the skirt 72 from the vicinity of the ring groove 73. The linear groove 74 guides the lubricating oil collected in the ring groove 73 toward the crank chamber 25. The grooves 73, 74 enable sufficient lubrication of various moving parts, such as the bearings 19, in the crank chamber 25.

The screen coating apparatus 45 employed in this embodiment to transfer the coating material C to a piston workpiece 69W is similar to that employed in the first embodiment. As shown in FIG. 7(*b*), a transfer pattern 78*a* differing from the pattern of the first embodiment is used in this embodiment. The transfer pattern 78*a* is formed on the screen 78 in correspondence with a layout of the outer surface of the piston body 70. The transfer pattern 78*a* blocks the transfer of the coating material C at portions that correspond to the ring groove 73 and the linear groove 74. In other words, the screen 78 includes a first mask 78*b*, which masks the ring groove 73, and second masks 78*c*, which mask the linear groove 74. The movement of the screen 78 and the rotation of the workpiece 69W is synchronized to match the first and second masks 78*b*, 78*c* with the associated grooves 73, 74.

The employment of the coating apparatus 45 using the transfer pattern 78*a* positively transfers the coating material C only to the peripheral surface 70*a* of the workpiece 69W. The workpiece 69W then undergoes the drying, calcination, and grinding processes to form a coating 75, which has a predetermined thickness, on the peripheral surface 70*a*. The advantageous effects obtained in the above embodiments are also obtained in this embodiment.

The seam formed by the ends of the coating 75 is preferably located on the side of the piston 69 where the swash plate 62 enters the piston 69, and also, the seam should preferably be located at a position that is angularly spaced from the lines of intersection between the outer surface of the piston 69 and a plane that contains both the axis of the drive shaft 18 and the axis of the piston 69. This is because the forces between the piston 69 and the bore 21 are relatively higher along such lines of intersection. In other words, the seam should be located where the forces applied to the piston surface is relatively weaker to avoid peeling of the coating 75.

A fourth embodiment according to the present invention will now be described with reference to FIG. 7(*c*). In this embodiment, the coating material C is transferred to the piston workpiece 69W by employing a roll coating apparatus 51 like that of the second embodiment.

The printing roller 79 and the workpiece 69W are shown in FIG. 7(*c*). The layout shape of the peripheral surface 79*a* of the printing roller 79 is the same as that of the transfer pattern 78*a* on the screen 78. A first groove 79*b* corresponding to the ring groove 73 and a second groove 79*c* corresponding to the linear groove 74 are provided in the peripheral surface 79*a*. The first and second grooves 79*b*, 79*c* prevent the coating material from entering the grooves 73, 74 of the workpiece 69W. The ring groove 73 and the linear groove 74 may be formed on the workpiece 69W before application of the coating material C. As another option, the coating material C may be applied to the workpiece W so as to form the grooves 73, 74. In the latter case, a piston workpiece, which does not have grooves, is used. The coating 43 is applied to positions that exclude portions corresponding to the grooves. This enables formation of grooves having a depth equal to the thickness of the coating 43.

A fifth embodiment according to the present invention will now be described with reference to FIG. 8. In this embodiment, the present invention is applied to the single-headed piston 69 shown in FIG. 8. The piston 69 is light-weight due to a hollow portion 77 provided therein. The shape of the piston 69 is complicated due to the hollow portion 77. However, the employment of the coating apparatus 45 or the roll coating apparatus 51 of the above embodiments enables the coating material C to be transferred to the designated portions of the peripheral surface 70*a* in a conserved manner.

A sixth embodiment according to the present invention will now be described with reference to FIG. 9. In this embodiment, the present invention is applied to the single-headed piston 69 shown in FIG. 9. In the piston 69 having the illustrated shape, the employment of the coating apparatus 45 or the roll coating apparatus 51 of the above embodiments enables the coating material C to be transferred to the designated portions of the peripheral surface 70*a* in a conserved manner.

A seventh embodiment according to the present invention will now be described with reference to FIGS. 10, (10*a*) and 11. In this embodiment, the present invention is applied to a piston 122, which is employed in the compressor of the first embodiment. The shape of the piston 122 differs from the shape of those employed in the above embodiments.

As shown in FIGS. 10, (10*a*) and 11, a piston 122 includes a workpiece 122W, which has two heads 122*a*, and a coating 143, which is applied to the peripheral surface of each head 122*a*. To apply the coating 143 on each head 122*a*, either the coating apparatus 45 or the roll coating apparatus 51 employed in the above embodiments is used. A spraying method may also be employed to apply the coating 143. A seal surface 144 is defined on the surface of the coating 143. As the piston 122 reciprocates, the seal surface 144 slides against the wall 121*a* of the cylinder bore 121. The seal surface 144 includes a first surface 145, which extends continuously for 360 degrees in the circumferential direction of the piston 122, and a second conically tapered surface 146, which extends in the circumferential direction only as far as a recess 141.

The radius of the first surface 145 is constant. The second surface 146, however, is tapered. The radius of the second surface 146 becomes smaller at locations farther from the first surface 145. The clearance between the bore wall 121*a* and the first surface 145 is substantially constant. The clearance between the bore wall 121*a* and the second surface 146 increases at locations farther from the first surface 121*a*. The clearance is about 100 micrometers at its maximum.

In compressors that employ pistons having a constant radius, the peripheral surface, or seal surface, of each piston slides against the wall of the associated cylinder bore. The sliding seals the space between the seal surface and the bore surface. The mist-like lubricating oil drawn into the compressor enters the clearance between the seal surface and the bore surface. This forms an oil film in the clearance. The oil film reduces friction and abrasion produced between the seal surface and the bore surface. To ensure the sealing between the seal surface and the bore surface, the dimension of the clearance is minimized. However, this makes it difficult to draw the lubricating oil into the clearance and form the oil film.

This problem is solved in this embodiment by increasing the clearance at the crank chamber side of the piston between the bore wall 121*a* and the seal surface 144. Therefore, when the piston 22 moves from the top dead center position to the bottom dead center position, the mist-like lubricating oil suspended in the refrigerant gas and the lubricating oil on the bore wall 21*a* are efficiently drawn into the clearance between the seal surface 144 and the bore surface 121*a*. This reduces the friction produced between the seal surface 144 and the bore surface 121*a* and abrasion of the surfaces 121*a*, 144.

The reduction of friction positively prevents seizure of the piston 122. The decrease in abrasion maintains satisfactory sealing of the compressor chamber 23 over a long period of time.

Furthermore, the sliding of the first surface 145 against the bore surface 121*a* securely seals the recess 141 from the compression chamber 23.

The piston workpiece 22W is tapered to taper the seal surface 146. The employment of the tapered workpiece 22W facilitates application of the coating in comparison with tapering the seal surface 146 by gradually varying the thickness of the coating on a piston having a constant radius.

Although several embodiments of the present invention have been described so far, it should be apparent to those skilled in the art that the present invention may be embodied in many other specific forms without departing from the spirit or scope of the invention. More particularly, it should be understood that the present invention may be embodied in the forms described below.

Figure 8:
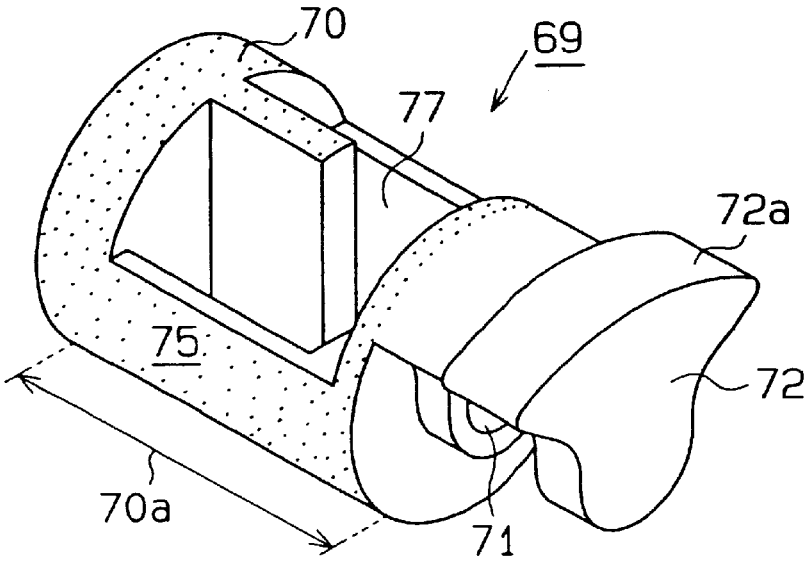
FIG. 8 is a perspective view showing a single-headed piston according to a fifth embodiment of the present invention.
Figure 9:
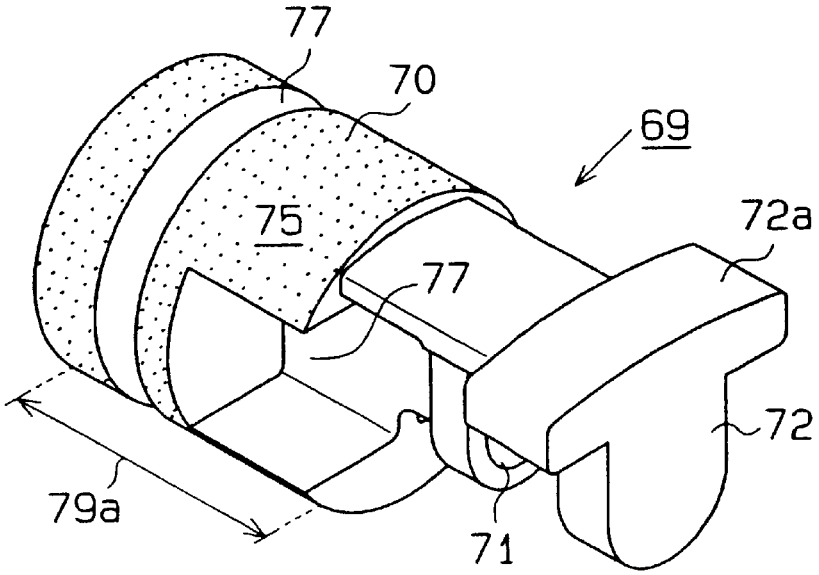
FIG. 9 is a perspective view showing a single-headed piston according to a sixth embodiment of the present invention.

(1) In the pistons 69, which are shown in FIGS. 7 to 9, the peripheral surface 72*a* of the skirt 72 contacts the inner wall of the housing 12. Therefore, the coating may also be applied to the peripheral surface 72*a* by either the coating apparatus or the roll coating apparatus. In this case, the coating of the peripheral surface 72*a* and the coating of the peripheral surface 70*a* are carried out in different processes. When employing the screen coating apparatus 45, the coating material C is transferred to the piston workpiece 69W by flexing the screen without rotating the workpiece 69W.

(2) Instead of using PTFE as the material of the coatings 43, 75, 143, polyimide resin or polyamideimide resin, may be used. Furthermore, a material having anti-friction and anti-abrasion properties, such as a mixture of molybdenum disulfide and graphite may be applied to the material of the coatings 43, 75, 143.

(3) In the roll coating apparatus 51, the thickness of the applied coating material C is adjusted by the comma roller 54. However, an air knife or a doctor knife may be used in lieu of the comma roller 54. In this case, the knife is arranged above the metal roller 53, the printing roller 55, or the piston workpiece 22W.

(4) In the roll coating apparatus 51, the metal roller 53 may be eliminated. In this case, a portion of the printing roller 55 is dipped into the coating material C contained in the pan 52. The comma roller 55 is spaced from the printing roller 55 by a predetermined interval.

(5) In the seventh embodiment, the second surface 146 of the piston workpiece 122W may have a constant radius. In this case, the tapered surface is formed by varying the thickness of the coating 43 applied to the second surface 146.

(6) In the seventh embodiment, the second surface 146 may have a constant radius while the first surface 145 has a smaller radius. The clearance between the bore surface 121*a* and the first surface 145 widens at the compression chamber side. Furthermore, both the first surface 145 and the second surface 146 may be tapered. In this case, sealing is ensured by the section between the first surface 145 and the second surface 146.

(7) In the seventh embodiment, the radius of the second surface 146 becomes smaller at a constant rate. However, the radius of the second surface 146 may also become smaller at a different rate.

(8) If the radius of the second surface 146 is smaller than that of the first surface 145, the radius of the second surface 146 may be constant. This forms the seal surface 144 in a two-step manner. The second surface 146 may also be formed in a manner so that it has more than two steps.

Therefore, the present examples and embodiments are to be considered as illustrative and not restrictive and the invention is not to be limited to the details given herein, but may be modified within the scope of the appended claims.

What is claimed is:

1. A piston for use in a compressor, wherein the outer surface of the piston includes an outer sliding surface that has a curvature conforming to the curvature of a cylinder bore, and wherein the outer sliding surface is print-coated with a lubricant coating and wherein said compressor includes:

a housing;

a drive shaft rotatably supported by the housing;

a swash plate integrally rotatable with the drive shaft;

a slot formed in the piston for receiving the swash plate;

a shoe positioned between the swash plate and the piston for converting rotational movement of the swash plate to reciprocating movement of the piston; and a shoe seat formed in the piston for supporting the shoe, wherein the periphery of the swash plate enters the slot from a first location on the outer surface of the piston and exits the piston from a second location on the piston, wherein the second location is substantially on an opposite side of the piston with respect to the first location, and wherein a seam is formed by ends of the coating, and wherein the location of the seam is angularly spaced from the second location such that the seam is located where the force applied to the piston by the bore is relatively weaker.

2. A piston for use in a compressor, wherein the outer surface of the piston includes an outer sliding surface that has a curvature conforming to the curvature of a cylinder bore, and wherein the outer sliding surface is print-coated with a lubricant coating, and wherein said compressor includes:

a housing;

a drive shaft rotatable supported by the housing;

a swash plate integrally rotatable with the drive shaft;

a slot formed in the piston for receiving the swash plate;

a shoe positioned between the swash plate and the piston for converting rotational movement of the swash plate to reciprocating movement of the piston; and a shoe seat formed in the piston for supporting the shoe, wherein the periphery of the swash plate enters the slot from a first location on the outer surface of the piston and exits the piston from a second location on the piston wherein the second location is substantially on an opposite side of the piston with respect to the first location, and wherein a seam is formed by ends of the coating, and wherein the location of the seam is closer to the first location than to the second location.

3. A piston for use in a cylinder bore of a compressor, the piston having a longitudinal axis and a piston head, the piston comprising:

a cylindrical surface portion adjacent to the piston head and having a coating thereon for slidably contacting a surface of said cylinder bore, and a conically tapered surface portion having a first end conjoining said cylindrical surface portion at an end thereof which is away from said piston head and tapering inwardly toward said longitudinal axis in direction away from said cylindrical surface portion to a second end thereof, said coating on said cylindrical surface portion extending on and covering said conical surface portion.

4. The piston according to claim 3, wherein the second portion has a minimum radius and a maximum radius, and a difference between the maximum and minimum radius is less than 100 micrometers.

5. The piston of claim 3, wherein said coating on said surfaces is a print coating providing a longitudinally extending seam along a lateral side of said piston.

* * * * *